US005972202A

United States Patent [19]

Benham et al.

[11] Patent Number: 5,972,202

[45] Date of Patent: Oct. 26, 1999

[54] HYDROTREATING OF HEAVY HYDROCARBON OILS WITH CONTROL OF PARTICLE SIZE OF PARTICULATE ADDITIVES

[75] Inventors: N. Kelly Benham; Barry B. Pruden, both of Calgary, Canada

[73] Assignee: Petro—Canada, Calgary, Canada

[21] Appl. No.: 08/816,383

[22] Filed: Mar. 13, 1997

Related U.S. Application Data

[60] Provisional application No. 60/013,453, Mar. 15, 1996.

[51] Int. Cl.[6] ..... C10G 47/22; C10G 45/00

[52] U.S. Cl. ..... 208/107; 208/48 R; 208/142; 208/264

[58] Field of Search ..... 208/48 R, 107, 208/108, 142, 143, 157, 176, 264

[56] References Cited

U.S. PATENT DOCUMENTS

| | | | |
|---|---|---|---|
| 3,681,231 | 8/1972 | Alpert et al. | 208/59 |
| 4,214,977 | 7/1980 | Ranganathan et al. | 208/108 |
| 4,285,804 | 8/1981 | Jacquin et al. | 208/48 R |
| 4,963,247 | 10/1990 | Belinko et al. | 208/112 |
| 4,969,988 | 11/1990 | Jain et al. | 208/108 |
| 5,374,348 | 12/1994 | Sears et al. | 208/107 |

*Primary Examiner*—Bekir L. Yildirim

[57] ABSTRACT

A process is described for controlling the size of additive or catalyst particles mixed with heavy hydrocarbon oil feedstock containing asphaltenes and metals and being subjected to hydrotreating. A slurry feed of a mixture of the heavy hydrocarbon oil feedstock and coke-inhibiting additive particles or catalyst particles is passed upwardly through a confined vertical hydrotreating zone in the presence of hydrogen gas, while removing from the top of the hydrotreating zone a mixed effluent containing a gaseous phase comprising hydrogen and vaporous hydrocarbon and a liquid phase comprising heavy hydrocarbon. The mixed effluent is passed through a separation vessel, while withdrawing from the top of the separator a gaseous stream comprising hydrogen and vaporous hydrocarbons and withdrawing from the bottom of the separator a liquid stream comprising heavy hydrocarbons and particles of coke-inhibiting additive or catalyst. At least part of the liquid stream containing heavy hydrocarbons and particles is recycled and an aromatic oil is added to the hydrotreating zone in an amount sufficient to substantially inhibit adsorption of asphaltenes on the surfaces of the particles and subsequent agglomeration of the additive or catalyst particles.

7 Claims, 2 Drawing Sheets

HYDROTREATING OF HEAVY HYDROCARBON OILS WITH CONTROL OF PARTICLE SIZE OF PARTICULATE ADDITIVES

This application claims the benefit of provisional application No. 60/013,453 filed on Mar. 15, 1996.

BACKGROUND OF THE INVENTION

This invention relates to the treatment of hydrocarbon oils and, more particularly, to the hydrotreating of heavy hydrocarbon oils in the presence of particulate additives.

Hydroconversion processes for the conversion of heavy hydrocarbon oils to light and intermediate naphthas of good quality for reforming feedstocks, fuel oil and gas oil are well known. These heavy hydrocarbon oils can be such materials as petroleum crude oil, atmospheric tar bottoms products, vacuum tar bottoms products, heavy cycle oils, shale oils, coal derived liquids, crude oil residuum, topped crude oils and the heavy bituminous oils extracted from oil sands. Of particular interest are the oils extracted from oil sands and which contain wide boiling range materials from naphthas through kerosene, gas oil, pitch, etc., and which contain a large portion of material boiling above 524° C. equivalent atmospheric boiling point.

As the reserves of conventional crude oils decline, these heavy oils must be upgraded to meet the demands. In this upgrading, the heavier materials is converted to lighter fractions and most of the sulphur, nitrogen and metals must be removed.

This can be done either by a coking process, such as delayed of fluidized coking, or by a hydrogen addition process such as thermal or catalytic hydrocracking. The distillate yield from the coking process is typically about 80 wt % and this process also yields substantial amounts of coke as by-product.

Work has also been done on an alternate processing route involving hydrogen addition at high pressures and temperatures and this has been found to be quite promising. In this process, hydrogen and heavy oil are pumped upwardly through an empty tubular reactor in the absence of any catalyst. It has been found that the high molecular weight compounds hydrogenate and/or hydrocrack into lower boiling ranges. Simultaneous desulphurization, demetallization and denitrogenation reactions take place. Reaction pressure up to 24 MPa and the temperature up to 490° C. have been employed.

Research has been conducted on additives which can suppress coking reaction or can remove the coke from the reactor. It has been shown in Ternan et al., Canadian Patent No. 1,073,389, issued Mar. 10, 1980 and Ranganathan et al., U.S. Pat. No. 4,214,977, issued Jul. 29, 1980, that the addition of coal or coal-based additive results in the reduction of coke deposition during hydrocracking. The coal additives act as sites for the deposition of coke precursors and thus provide a mechanism for their removal from the system.

Ternan et al., Canadian Patent No. 1,077,917 describes a process for the hydroconversion of a heavy hydrocarbonaceous oil in the presence of a catalyst prepared in situ from trace amounts of metals added to the oil as oil soluble metal compounds.

In U.S. Pat. No. 3,775,286, a process is described for hydrogenating coal in which the coal was either impregnated with hydrated iron oxide or dry hydrated iron oxide powder was physically mixed with powdered coal. Canadian Patent No. 1,202,588 describes a process for hydrocracking heavy oils in the presence of an additive in the form of a dry mixture of coal and an iron salt, such as iron sulphate.

Particularly useful additive particles are those described in Belinko et al., U.S. Pat. No. 4,963,247, issued Oct. 16, 1990. Thus, the particles are typically ferrous sulfate having particle sizes less than 45 $\mu$m and with a major portion, i.e. at least 50% by weight, preferably having particle sizes of less than 10 $\mu$m.

Development of such additives has allowed the reduction of reactor operating pressure without coking reaction. However the injection of large amounts of fine additive is costly, and the application is limited by the incipient coking temperature, at which point mesophase (a pre-coke material) is formed in increasing amounts.

Heavy hydrocarbon oils typically contain asphaltenes and metals which can lead to deactivation of catalysts and agglomeration of particulate additives. The asphaltenes are present as a colloidal suspension which during hydrotreating tends to be adsorbed on the surfaces of the particles and also cause the particles to agglomerate. Jacquin et al., in U.S. Pat. No. 4,285,804 try to solve the problem of asphatenes by a rather complex process in which a solution of fresh metal catalyst is injected into fresh feedstock prior to heating.

Further, it is shown in Jain et al., U.S. Pat. No. 4,969,988 that conversion can be further increased through reduction of gas hold-up by injecting an anti-foaming agent, preferably into the top section of the reactor.

Sears et al., U.S. Pat. No. 5,374,348 teaches recycle of heavy vacuum fractionator bottoms to the reactor to reduce overall additive consumption by 40% more.

It is the object of the present invention to provide a process for hydrotreating heavy hydrocarbon oils using additive particles in the feedstock to suppress coke formation in which improved utilization of additive particles can be achieved by retarding the tendency of the asphaltenes to be adsorbed on the surface of the particles and thereby retard the subsequent agglomeration of the particles.

SUMMARY OF THE INVENTION

According to the present invention, it has now surprisingly been discovered that it is a relatively easy matter to substantially retard the coating of additive or catalyst particles with asphaltenes and subsequent agglomerating during hydrotreating of heavy hydrocarbon oils. Thus, the problem is solved by providing in the hydrotreating phase a sufficient quantity of aromatic oil such that the asphaltenes in the heavy hydrocarbon oil feedstock are substantially prevented from fixing themselves to the additive particles. Within the present invention, hydrotreating includes a process conducted at hydrocracking conditions.

The asphaltenes are polar, high molecular weight materials insoluble in pentane but soluble in toluene. These asphaltenes are normally held in colloidal suspension in crude oils through mutual attraction with resins (polar aromatics) and aromatics. It appears that the affinity of resins and aromatic oils for asphaltenes (or vise versa) is shared by fine additive or catalyst particles utilized in hydrotreating processes. This discovery has led to a scheme whereby particle size and additive effectiveness are controlled in the process.

It has been found that the adsorption of asphaltenes on the additive particles is reversible, and can be adjusted by addition of aromatic oil. It is believed that this happens because the asphaltenes are characterized as soluble in toluene, a low-boiling aromatic oil. It has previously been understood that the hydrocarbon material associated with the additive was mesophase or coke.

The aromatic oils added to the hydrotreating phase are typically in the gas oil range. They may be obtained from many different sources, e.g. a decant oil from a fluid catalytic cracking unit or a recycle stream of heavy gas oil from the hydroprocessing system itself. It may even be obtained from other waste industrial materials such as polystyrene waste.

A variety of additive particles can be used in the process of the invention, provided these particles are able to survive the hydrotreating process and remain effective as part of a recycle. The particles are typically of a relatively small size, e.g. less than about 100 $\mu$m and they may be as small as less than 10 $\mu$m. However, the invention also shows benefits with large particles, e.g. up to 1000 $\mu$m.

The particles may come from a wide variety of sources including coal, coke, red mud, natural inorganic iron-containing minerals and metal compounds selected from the groups IVB, VB, VIB, VIIB and VIII of the Periodic Table of Elements. These metals typically form metal sulphides during hydroprocessing.

The invention may also be used with a wide variety of hydrocarbon feedstocks, including those that are traditionally very difficult to process. These may include a variety of heavy and residual oils including heavy oils, tar sand bitumens, visbreaker vacuum residue, deaspalted bottom materials, grunge from the bottom of oil storage tanks, etc.

The process may also be used for co-processing of coal and for coal tar processing.

The process of this invention can be operated at quite moderate pressure, preferably in the range of 3.5 to 24 MPa, without coke formation in the hydrotreating zone. The reactor temperature is typically in the range of 350° to 600° C. with a temperature of 400° to 500° C. being preferred. The LHSV is typically below 4 $h^{-1}$ on a fresh feed basis, with a range of 0.1 to 3 $h^{-1}$ being preferred and a range of 0.3 to 1 $h^{-1}$ being particularly preferred.

Although the hydrotreating can be carried out in a variety of known reactors of either up or downflow, it is particularly well suited to a tubular reactor through which feed and gas move upwardly. The effluent from the top is preferably separated in a hot separator and the gaseous stream from the hot separator can be fed to a low temperature, high pressure separator where it is separated into a gaseous stream containing hydrogen and less amounts of gaseous hydrocarbons and liquid product stream containing light oil product.

According to a preferred embodiment, particles of iron sulphate are mixed with a heavy hydrocarbon oil feed and pumped along with hydrogen through a vertical reactor. The liquid-gas mixture from the top of the hydrotreating zone can be separated in a number of different ways. One possibility is to separate the liquid-gas mixture in a hot separator kept at a temperature in the range of about 200°–470° C. and at the pressure of the hydrotreating reaction. A portion of the heavy hydrocarbon oil product from the hot separator is used to form the recycle stream of the present invention after secondary treatment. Thus, the portion of the heavy hydrocarbon oil product from the hot separator being used for recycle is fractionated in a distillation column with a heavy liquid or pitch stream being obtained which boils above 450° C. This pitch stream preferably boils above 495° C. with a pitch boiling above 524° C. being particularly preferred. This pitch stream is then recycled back to form part of the feed slurry to the hydrotreating zone. An aromatic gas oil fraction boiling above 400° C. is also removed from the distillation column and it is recycled back to form part of the feedstock to the hydrotreating zone for the purpose of controlling the ratio of polar aromatics to asphaltenes.

Preferably the recycled heavy oil stream makes up in the range of about 5 to 15% by weight of the feedstock to the hydrotreating zone, while the aromatic oil, e.g. recycled aromatic gas oil, makes up in the range of 15 to 50% by weight of the feedstock, depending upon the feedstock structures.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulphide and light hydrocarbon gases. This gaseous stream is passed through a scrubber and the scrubbed hydrogen may be recycled as part of the hydrogen feed to the hydrotreating process. The hydrogen gas purity is maintained by adjusting scrubbing conditions and by adding make up hydrogen.

The liquid stream from the low temperature-high pressure separator represents a light hydrocarbon oil product of the present invention and can be sent for secondary treatment.

According to an alternative embodiment, the heavy oil product from the hot separator is fractionated into a top light oil stream and a bottom stream comprising pitch and heavy gas oil. A portion of this mixed bottoms stream is recycled back as part of the feedstock to the hydrotreater while the remainder of the bottoms stream is further separated into a gas oil stream and a pitch product. The gas oil stream is then recycled to be feedstock to the hydrotreater as additional low polar aromatic stock for polar aromatic control in the system.

The solids concentration profile in a slurry-type reactor such as that described in U.S. Pat. No. 4,963,247, with fine additive and gas holdup control with antifoam, can be represented by an axial dispersion model. Relative solids concentrations in this model are logarithmic with height with the higher solids concentrations at the reactor bottom. This model reflects relative mixing intensity as well as particle size and size distribution. It is obviously advantageous to have a small range of solids concentrations in a reactor, and this can be achieved by aromatics control, which reduces particle size growth through the mechanisms described above.

The new discovery of this invention allows for:

a) more effective use of additive;
b) control of growth of additive particles, and more effective additive in that the surface is not blocked by adsorbed material;
c) higher gas rates in the reactor, if desired, through increased mixing;
d) higher proportion of recycled additive, now up to 90%$^+$, as no purge is needed for additive growth, but only to purge feed metals and non-convertible hydrocarbon material;
e) the possibility of utilizing metals from the feed, which will have higher probability of adsorbing on the additive and participating in the reaction.

BRIEF DESCRIPTION OF THE DRAWINGS

For a better understanding of the invention, reference is made to the accompanying drawings in which.

DESCRIPTION OF THE PREFERRED EMBODIMENTS

Figure 1:
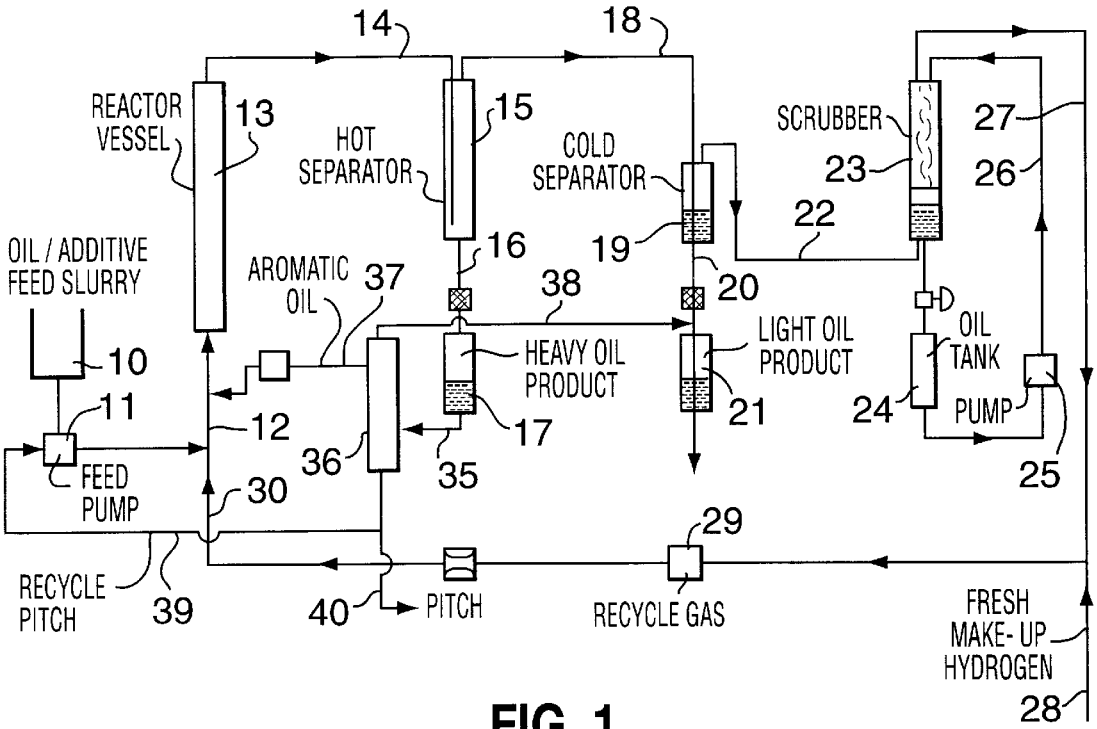
FIG. 1 is a schematic flow sheet showing a typical hydrotreating process to which the present invention may be applied.

In the hydrotreating process as shown in the drawing, an iron salt additive is mixed together with a heavy hydrocarbon oil feed in a feed tank 10 to form a slurry. This slurry, including heavy oil or pitch recycle 39, is pumped via feed pump 11 through an inlet line 12 into the bottom of an empty reactor 13. Recycled hydrogen and make up hydrogen from line 30 are simultaneously fed into the reactor through line 12. A gas-liquid mixture is withdrawn from the top of the reactor through line 14 and introduced into a hot separator 15. In the hot separator the effluent from tower 13 is separated into a gaseous stream 18 and a liquid stream 16. The liquid stream 16 is in the form of heavy oil which is collected at 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen-rich stream 22 is passed through a packed scrubbing tower 23 where it is scrubbed by means of a scrubbing liquid 24 which is recycled through the tower by means of a pump 25 and recycle loop 26. The scrubbed hydrogen-rich stream emerges from the scrubber via line 27 and is combined with fresh make-up hydrogen added through line 28 and recycled through recycle gas pump 29 and line 30 back to reactor 13.

The heavy oil collected at 17 is used to provide the heavy oil recycle of the invention and before being recycled back into the slurry feed, a portion is drawn off via line 35 and is fed into fractionator 36 with a bottom heavy oil stream boiling above 450° C., preferably above 524° C. being drawn off via line 39. This line connects to feed pump 11 to comprise part of the slurry feed to reactor vessel 13. Part of the heavy oil withdrawn from the bottom of fractionator 36 may also be collected as a pitch product 40.

The fractionator 36 may also serve as a source of the aromatic oil to be included in the feedstock to reactor vessel 13. Thus, an aromatic heavy gas oil fraction 37 is removed from fractionator 36 and is feed into the inlet line 12 to the bottom of reactor 13. This heavy gas oil stream preferably boils above 400° C. A light oil stream 38 is also withdrawn from the top of fractionator 36 and forms part of the light oil product 21 of the invention.

Certain preferred embodiments of this invention are illustrated by the following non-limiting Examples.

Example 1

An earlier publication Reilly, I. G. et al, Chem. Eng. Sci. Vol. 45, No. 8, pp. 2293–2299, (1990) has shown that the axial solids concentration in a three phase bubble column follows a logarithmic distribution of the type.

$$\frac{C_x}{C_T} = \exp[V_p[L - X]/D_s]$$

where $C_x$ and $C_T$ are solids concentration at any height x and the top of the column T. $V_p$ is the particle settling velocity and L is the total column height. $D_s$ is the solids axial dispersion coefficient. In this publication, a plot of In ($C_x$/$C_T$) against axial position is a straight line, the slope of which depends on the ratio $V_p/D_s$. The value of $D_s$ in turn depends on $V_p(D_s V_p^{0.3})$. The particle diameter, which yields $V_p$ through Stokes' law ($V_p d_p^2$), is a strong determinant of particle concentration profile. This is shown in the equation $$\frac{C_x}{C_T} = \exp[(L - X)kd_p^{1.4}] \text{ where } k \text{ is a constant}$$

The solids concentration in the reactor bottom is (x=0) is set by this equation. The solids concentration at the reactor top must increase or decrease until the overall solids material balance is satisfied (no accumulation).

Example 2

This example gives data from commercial operation of a nominal 5000 BPD hydrotreating unit using a flow path as shown in FIG. 1. The reactor in this case was 2 m in diameter by 21.3 m high. Conditions for a run using visbreaker vacuum tower bottoms feedstock with aromatics addition and pitch recycle were as follows: Liquid Charge:

| | |
|---|---|
| Fresh feed | 2570 BPD, 6° API |
| Aromatics addition | 800 BPD |
| Recycle of Pitch | 550 BPD |
| Total Feed | 3920 BPD |
| Unit Temperature | 454° C. |
| Unit Pressure | 13.8 MPa (2000 psi) |
| Recycle Gas Purity | 90% wt |
| 524° C.$^+$ Conversion | 74% wt |
| $H_2$ Uptake | 865 SCFB |
| Additive Rate | 2.7 wt % iron sulfate based on feed. |

The fraction of 524° C.+material in the recycle pitch was varied to determine how this would affect the particle size of the additive in the reactor.

Table 1 below shows the effect of pitch recycle cut point on additive accumulation in the reactor. "Rx Ash", or Reactor Ash is the ash content of a reactor sample taken at the reactor mid-height. "P Ash" or Pitch Ash is the ash content of the recycle and product pitch. The parameters "Pitch", "524° C.$^+$" and "frP" are the percentage and fraction respectively of 524° C.$^+$material in the recycle and product pitch, a measure of the pitch cut point. In all cases, ash content is a measure of mineral matter in the sample, which is proportional to, and very nearly equal to, iron sulfate content.

TABLE 1

| Rx Ash % | P Ash % | frP fraction 524° C.$^+$ in Pitch |
|---|---|---|
| 7.75 | 9.14 | 0.44 |
| 7.81 | 6.48 | 0.53 |
| 7.57 | 5.22 | 0.55 |
| 9.93 | 5.75 | 0.67 |
| 4.4 | 2.01 | 0.70 |
| FCC Slurry Used | | |
| 9.49 | 8.64 | 0.69 |

Figure 2:
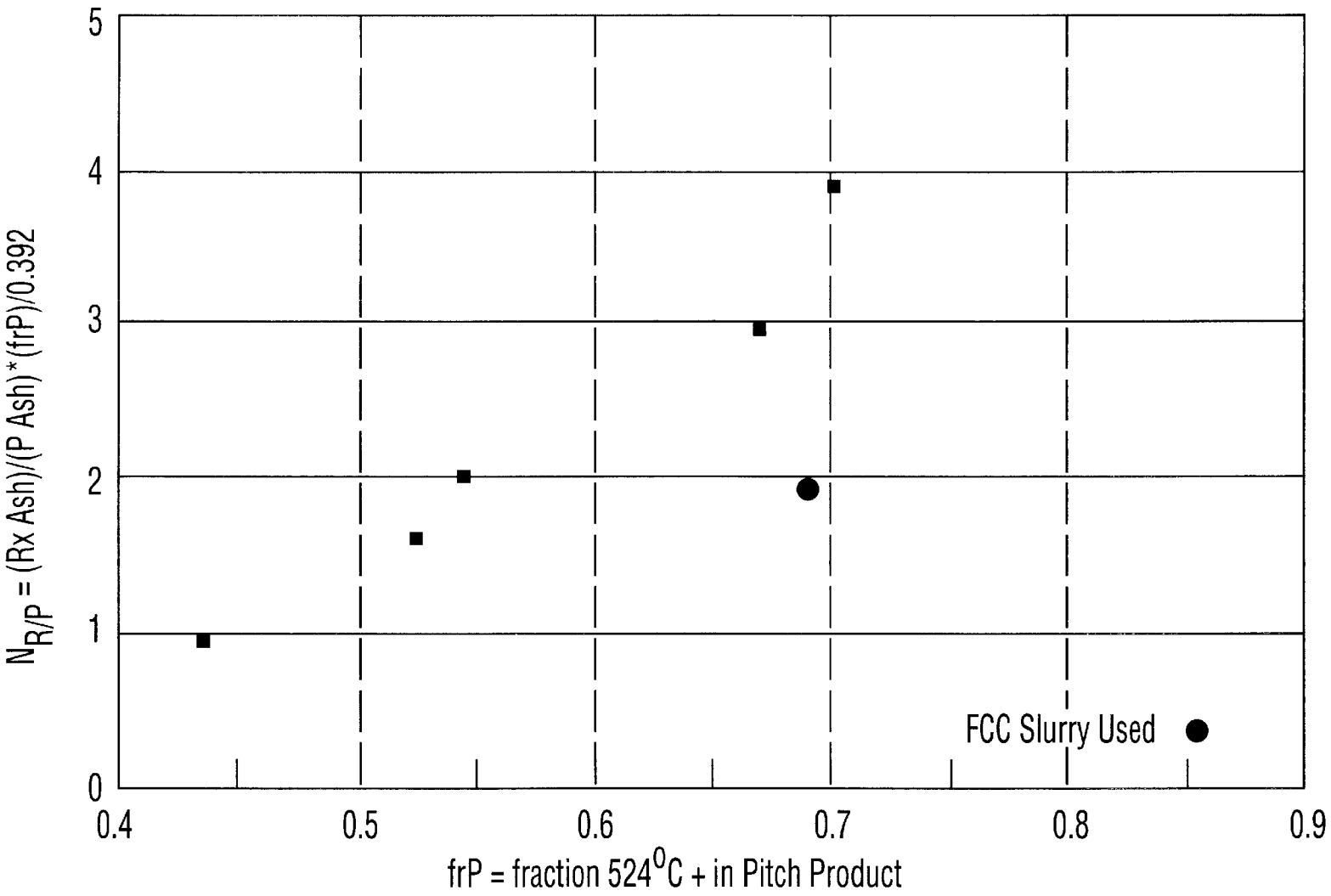
FIG. 2 is a plot of effect of VTB recycle cut point on additive accumulation in the reactor.

The above data was used to constuct FIG. 2. In this plot, the parameter:

$N_{R/P}$=(Rx Ash)/(P Ash)$^+$(frP)/(frR)

normalizes the ash concentration to the amount 524° C.$^+$in the reactor (frR) and pitch (frP), as is necessary. Based on a simulation, frR was set =0.392 for all cases. All data, from the 5000 bpd commercial reactor, were for similar gas superficial velocities and comparable pitch conversions.

The value of $N_{R/P}$ has to be 1.0 when calculated from (Rx Ash)/(frR) at the top of the reactor, as the ash remains with the same 524° C.$^+$material as it exits the reactor and flows through the separators and fractionation, ending up in the product pitch.

Due to the logarithmic relationship described in Example 2, the ash content of a reactor middle sample is higher than at the reactor top, and the value of $N_{R/P}$ accordingly is higher at this location. Historical numbers for frP of 0.9 were around 3.0.

FIG. 2 shows that $N_{R/P}$ for the reactor middle samples decreased with pitch cut-point, when the unit was operating at steady state. This can be explained by a decrease in particle size, decreasing $N_{R/P}$ according to the equations in Example 1. It is also explained by a decrease in the amount of 524° C.$^+$in the reactor as a function of pitch cut point. An increase in gas oil in the pitch recycle increase the gas oil and thus the amount of aromatic oil in the reactor, but not enough to explain the large changes observed. Recycle pitch represents only about ⅙ of the total feed to the unit.

In all tests except one, the pitch recycle was used to slurry fresh additive. In the exception, Decant oil, or FCC slurry was used to make-up additive, and pitch was recycled through the feed pump. The FCC slurry oil appears to help to decrease particle size still further.

It is evident from the above tests that increasing aromatic oil in the reactor serves to decrease particle size, so that the reactor ash (measured in mid-reactor) decreases.

We claim:

1. A process for controlling the size of additive or catalyst particles mixed with heavy hydrocarbon oil feedstock containing asphaltenes and metals and being subjected to hydrotreating, which comprises passing a slurry feed of a mixture of said heavy hydrocarbon oil feedstock and coke-inhibiting additive particles or catalyst particles having average particle sizes less than 100 $\mu$m upwardly through a confined vertical hydrotreating zone in the presence of hydrogen gas, removing from the top of the hydrotreating zone a mixed effluent containing a gaseous phase comprising hydrogen and vaporous hydrocarbon and a liquid phase comprising heavy hydrocarbon with entrained coke-inhibiting particles, passing said mixed effluent through a separation vessel, withdrawing from the top of the separator a gaseous stream comprising hydrogen and vaporous hydrocarbons, withdrawing from the bottom of the separator a liquid stream comprising ditch and entrained particles of coke-inhibiting additive or catalyst, recycling to the hydrotreating zone at least part of said liquid stream containing pitch and entrained coke-inhibiting particles and adding to the hydrotreating zone an aromatic oil boiling in the heavy gas oil range in an amount sufficient to substantially inhibit adsorption of asphaltenes on the surfaces of the particles and thereby substantially inhibit subsequent agglomeration of the additive or catalyst particles, wherein the amount of aromatic oil added to the hydrotreating zone is greater than the amount of pitch recycled to the hydrotreating zone.

2. A process according to claim 1 wherein the aromatic oil has a boiling point above about 400° C.

3. A process according to claim 1 wherein the aromatic oil is decant oil from a fluid catalytic cracker.

4. A process according to claim 2 wherein the aromatic oil is a recycled stream of heavy has oil obtained by fractionating the liquid stream from the separation vessel.

5. A process according to claim 2 wherein the aromatic oil comprises about 15 to 50% by weight of the feedstock to the hydrotreating zone and the pitch recycle comprises about 5 to 15% by weight of the feedstock.

6. A process according to claim 5 wherein the particles comprise metals which are or form metal sulphides during hydrotreating.

7. A process according to claim 5 wherein the hydrotreating zone is operated at a temperature in the range of about 350 to 600° C. and a pressure in the range of about 3.5 to 24 MPa.

* * * * *